US005794407A

United States Patent [19]

Smekens

[11] Patent Number: 5,794,407

[45] Date of Patent: Aug. 18, 1998

[54] ASEPTIC CHEMICAL TRANSFER SYSTEM

[75] Inventor: Daniel P. Smekens, Bonheiden, Belgium

[73] Assignee: Pharmacia & Upjohn Company, Kalamazoo, Mich.

[21] Appl. No.: 863,728

[22] Filed: May 27, 1997

Related U.S. Application Data

[62] Division of Ser. No. 297,323, Aug. 29, 1994, Pat. No. 5,715,646.

[51] Int. Cl.[6] ..... B65B 55/00

[52] U.S. Cl. ..... 53/428; 53/440; 53/426; 53/449; 53/468

[58] Field of Search ..... 241/101.2; 141/65, 141/69, 93, 97, 253, 346, 383; 53/111 R, 111 RC, 121, 127, 173, 175, 167, 512, 381.4, 502, 503, 268, 273, 281, 283, 428, 449, 468, 570, 440, 426

[56] References Cited

U.S. PATENT DOCUMENTS

| | | | |
|---|---|---|---|
| 2,283,867 | 5/1942 | Flosdorf et al. | 53/428 X |
| 3,932,979 | 1/1976 | Stock et al. | 53/381.4 X |
| 3,966,899 | 6/1976 | Nakai et al. | 424/19 |
| 4,233,212 | 11/1980 | Otoi et al. | 424/63 X |
| 4,260,591 | 4/1981 | Benjamin et al. | 423/267 |
| 4,406,822 | 9/1983 | Sanders et al. | 252/445 Z |
| 4,446,674 | 5/1984 | Inada | 53/273 X |
| 4,510,737 | 4/1985 | Ellert | 53/381.4 X |
| 4,688,371 | 8/1987 | Hecht | 53/570 X |
| 4,834,913 | 5/1989 | Aseltine et al. | 252/601 |
| 4,991,633 | 2/1991 | Wong | 53/512 X |
| 4,999,978 | 3/1991 | Kohlbach et al. | 53/381.4 X |
| 5,144,992 | 9/1992 | Jaerger et al. | 141/93 X |
| 5,263,521 | 11/1993 | Brossard et al. | 141/346 X |
| 5,322,095 | 6/1994 | Bolz | 141/65 X |
| 5,484,004 | 1/1996 | Bolz | 141/346 |
| 5,490,546 | 2/1996 | Lhoest | 141/346 |

*Primary Examiner*—Daniel Moon
*Attorney, Agent, or Firm*—Flynn, Thiel, Boutell & Tanis, P.C.

[57] ABSTRACT

A method and an apparatus for aseptically producing, harvesting and packaging a pharmaceutical product. A section of the apparatus includes an aseptic reactor and structure for introducing a reactant thereinto so that a reaction can be conducted for the purpose of producing a pharmaceutical product. The pharmaceutical product is subsequently introduced into a filter/dryer for the purpose of recovering the pharmaceutical product. Thereafter, the filtered/dried pharmaceutical product is delivered to a hammer mill for delumping or a micronizing mill for calibration and sizing the recovered product to produce a final powdered product. Thereafter, the final powdered product is introduced into a dosing device and aseptically introduced into a transportable bin. The small bins are encased inside of a sterile bag for transport and further aseptic handling.

12 Claims, 13 Drawing Sheets

ASEPTIC CHEMICAL TRANSFER SYSTEM

This is a division of Ser. No. 08/297,323, filed Aug. 29, 1994 now U.S. Pat. No. 5,715,646.

FIELD OF THE INVENTION

This invention relates to a method of aseptically producing, harvesting and packaging a pharmaceutical product as well as an apparatus for performing the method.

BACKGROUND OF THE INVENTION

During the production of a powdered product and effecting a packaging of same, care is required in dosing the product in a manner that will not cause the powdered product to contaminate the local environment. It has, of course, been known to orient dosing equipment in sealed chambers which are subjected to a pressure control. As a result, any powdered product intending to escape the dosing apparatus will be limited to the sealed chamber and any filtering equipment utilized to filter the air as it exits the sealed chamber. Nevertheless, powdered product has a tendency to pollute the room, its content and to gather on the exterior surface of the packages into which the powdered product is placed and, therefore, makes the subsequent handling of the packaging a delicate matter.

Accordingly, it is an object of the invention to provide a method and apparatus for aseptically producing, harvesting and packaging of a pharmaceutical product wherein methodology and apparatus has been provided for making the handling of the packaging following a filling thereof with pharmaceutical product less critical.

It is a further object of the invention to provide a method and apparatus, as aforesaid, wherein the powdered product is placed into a transportable bin encased inside a sealed and sterile bag.

It is a further object of the invention to provide a method and an apparatus, as aforesaid, wherein the powdered product is weighed before it is filled into the transportable bin so that the quantity of product placed into the transportable bin can be easily monitored.

It is a further object of the invention to provide a method and an apparatus, as aforesaid, wherein, and in series, an aseptic reactor is provided for producing pharmaceutical product, an aseptic filter/dryer being provided for harvesting the powdered product, an aseptic hammer mill being provided for delumping or micronizing mill for calibration the recovered pharmaceutical product to produce a final powdered product, an aseptic dosing device being provided for facilitating a dosing to an aseptic filling station so that the final powdered product can be introduced into a transportable bin, which transportable bin encased inside a sealed and sterile bag.

SUMMARY OF THE INVENTION

In general, the objects and purposes of the invention are met by providing a method and an apparatus for aseptically producing, harvesting and packaging a pharmaceutical product. A section of the apparatus includes an aseptic reactor and structure for introducing a reactant thereinto so that a reaction can be conducted for the purpose of producing a pharmaceutical product. The pharmaceutical product is subsequently introduced into a filter/dryer for the purpose of recovering the pharmaceutical product. Thereafter, the filtered/dried pharmaceutical product is delivered to a hammer mill for delumping the recovered product to produce a final powdered product. Thereafter, the final powdered product is aseptically introduced into a dosing device and into a transportable bin.

BRIEF DESCRIPTION OF THE DRAWINGS

Further objects and purposes of this invention will be apparent to persons acquainted with apparatus of this general type upon reading the following specification and inspecting the accompanying drawings, in which.

DETAILED DESCRIPTION

Figure 1:
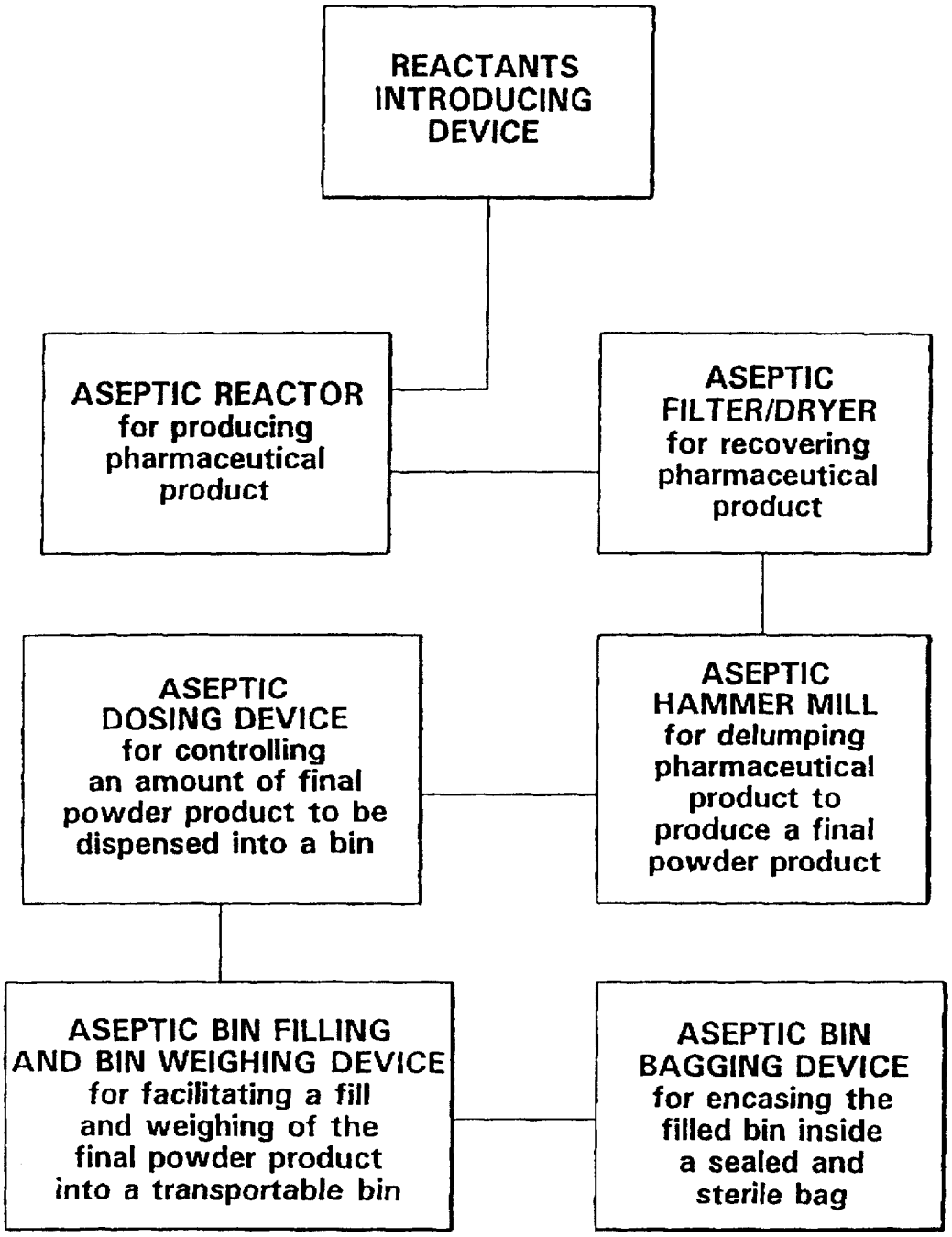
FIG. 1 is a schematic block diagram setting forth a methodology for aseptically producing, harvesting, and packaging a pharmaceutical product in accordance with the invention.

Certain terminology will be used in the following description for convenience in reference only and will not be limiting. The words "up", "down", "right" and "left" will designate directions in the drawings to which reference is made. The words "in" and "out" will refer to directions toward and away from, respectively, the geometric center of the device and designated parts thereof. Such terminology will include the words above specifically mentioned, derivatives thereof and words of similar import.

Figure 3:
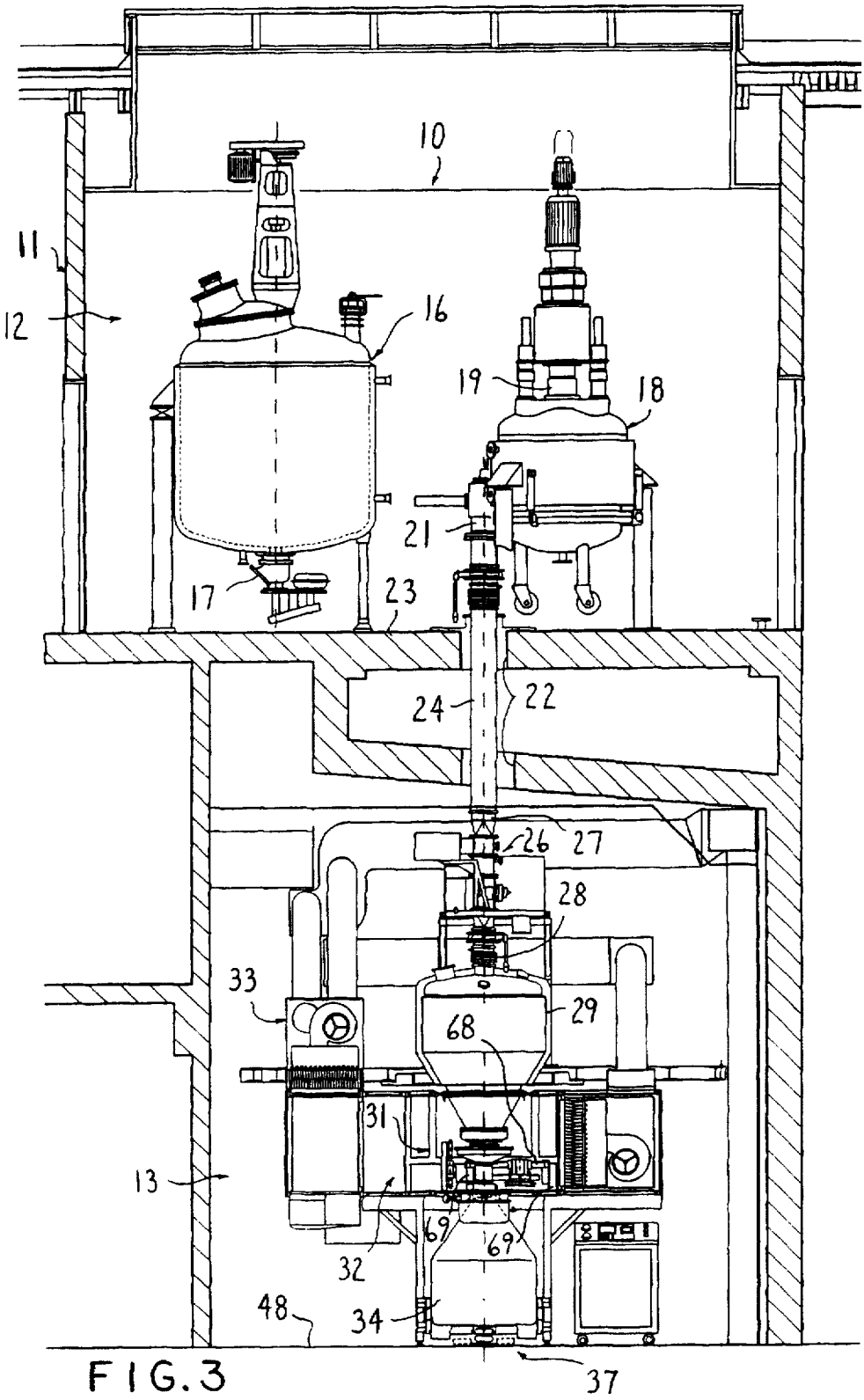
FIG. 3 is a side elevational view of an apparatus for aseptically producing, harvesting and packaging a pharmaceutical product.

FIG. 3 illustrates a side elevational view of an apparatus 10 for aseptically producing, harvesting and packaging a pharmaceutical product. The apparatus is housed within a building 11 which, in this particular embodiment, includes an upper level 12 and a lower level 13. The upper level 12 includes a room 14 in which is housed an aseptic reactor 16 of any conventional variety adapted to receive therein a reactant. The reactor 16 has an outlet 17 through which produced pharmaceutical product and other by-products can be conveyed. The room 14 also includes an aseptic filter/dryer 18 having an inlet port at any convenient location, as at 19 and an outlet port as at 21. Produced pharmaceutical product produced aseptically in the reactor 16 can, when the appropriate time has arrived, be conveyed out of the outlet port 17 of the reactor 16 into the inlet port 19 through a not illustrated connection whereat it is aseptically filtered and/or dried in the filter/dryer 18 so that the produced pharmaceutical product can be recovered and delivered through the outlet port 21 to the next phase of the process. Since the aseptic reactor 16 and the aseptic filter/dryer are of a conventional construction, no further discussion concerning same is believed to be necessary.

A hole 22 is provided in the flooring 23 between the upper level 12 and the lower lever 13 so as to facilitate the passage of a pipe 24 therethrough, the upper end of the pipe 24 being connected in circuit with the outlet 21 of the aseptic filter/dryer 18 and the lower end thereof being connected to an inlet 27 to an aseptic hammer mill 26. The aseptic hammer mill 26 is conventional and effects a delumping of the recovered pharmaceutical product to produce a final powdered product at the outlet 28 therefrom. Since the aseptic hammer mill 26 is of a conventional construction, no further discussion pertaining to it is believed necessary.

The recovered pharmaceutical product, following its being reduced to a powdered product in the hammer mill 26, is delivered to an aseptic hopper 29 beneath which there is provided an aseptic dosing device 31. The dosing device 31 is housed within an aseptically maintained sealed chamber 32, the sealed chamber 32 being maintained at a pressure less than atmospheric pressure by a filtered air supply and air exhaust system 33.

The apparatus that has been described heretofore also includes circuitry for introducing a substance for rendering the reactor 16, the filter/dryer 18, the piping 24, the hammer mill 26, the storage hopper 29 and the dosing device 31 aseptic without necessitating a disconnecting of the various components from one another. Valving and timing controls (not shown) are provided for this purpose.

While FIG. 3 illustrates a presterilized 600 liter transportable bin 34 oriented beneath the dosing device 31, FIGS. 5–14 will be referenced for illustrating the methodology of filling the transportable bin, but utilizing a smaller variety transportable bin, such as a 16 liter transportable bin 36. The transportable bin 36 is oriented in an aseptic filling station 37 which includes a plurality of upstanding support members 38 mounted on an elevatable platform 39. Each of the upstanding support members 38 includes an elongated guide bar 41 extending generally parallel thereto. A guide mechanism 42 is adapted to move lengthwise along the length of the guide bars 41 so as to cause a secondary platform 43 provided thereon to become elevatable. The secondary platform 43 houses a scale 46 so that it becomes movable with the secondary platform 43. A drive mechanism 44 is provided for moving the secondary platform 43 up and down.

The elevatable platform 39 is supported on a drive mechanism 47 which is, in turn, mounted on the floor or a convenient support surface 48 of the lower level 13 of the building 11.

A plurality of support pins 49 are provided at the upper ends of each of the upstanding support members 38. The purpose of these upstanding pins 49 will become apparent below.

Prior to a placement of the transportable bin 36 onto the upper surface of the secondary platform 43, the transportable bin is preassembled with the binstopper 51 placed sealingly into the open upper end of the transportable bin 36 and placed into the interior of the open top plastic bag 53. The plate 57 closed at the upper end with a bagstopper 58 has a depending cylindrical shell 56 used to hold and secure a rim region of the open end of the plastic bag 53 by means of a plurality of elastic O-rings 54. This subassembly is sterilized in a dry heat oven at a temperature of 150° to bring all interior parts and the exterior into an aseptic condition. The bagstopper 58 is releasably secured to the plate 57 and provides a double protection for the aseptic condition inside the transportable bin 36.

This subassembly is brought to the filling station, installed on the secondary platform, the plate 57 resting on the upper ends of the support and the preguiding pins 49 so as to be correctly positioned and aligned with the disposing opening 79 and the aseptic dosing device 31.

The sealed chamber 32 has therein an upstanding support 61 mounted on a bottom wall 62 of the chamber 32 for supporting a vertically upstanding rod 63. A linear actuator mechanism 64 is supported for movement along the length of the rod 63 and carries therewith a bracket member 65.

The dosing mechanism 31 includes a slide gate mechanism 66 that is supported for reciprocal movement so as to open and close the lower end of the storage hopper 29 in a conventional manner. When the slide gate mechanism 66 is in the opened condition, powdered product will dump down into a housing 67 having an extendable sleeve 68 oriented at the lower side thereof. The sleeve 68 can be extended and retracted due to its connection to the bracket assembly 65.

A pair of upstanding supports 69 are mounted on the bottom wall 62 of the sealed chamber 32 and each support an elongated shaft 71 extending horizontally therebetween. A linear actuator 72 is mounted for longitudinal movement along the length of the shaft 71. The linear actuator 72 has a bracket assembly 73 thereon which carries a further linear actuator 74, which linear actuator 74 has an elongated reciprocal rod 76 extending therefrom which has attached to the distal end thereof a further bracket assembly 77. A suction activated gripper 78 is secured to the bracket assembly 77.

Figure 16:
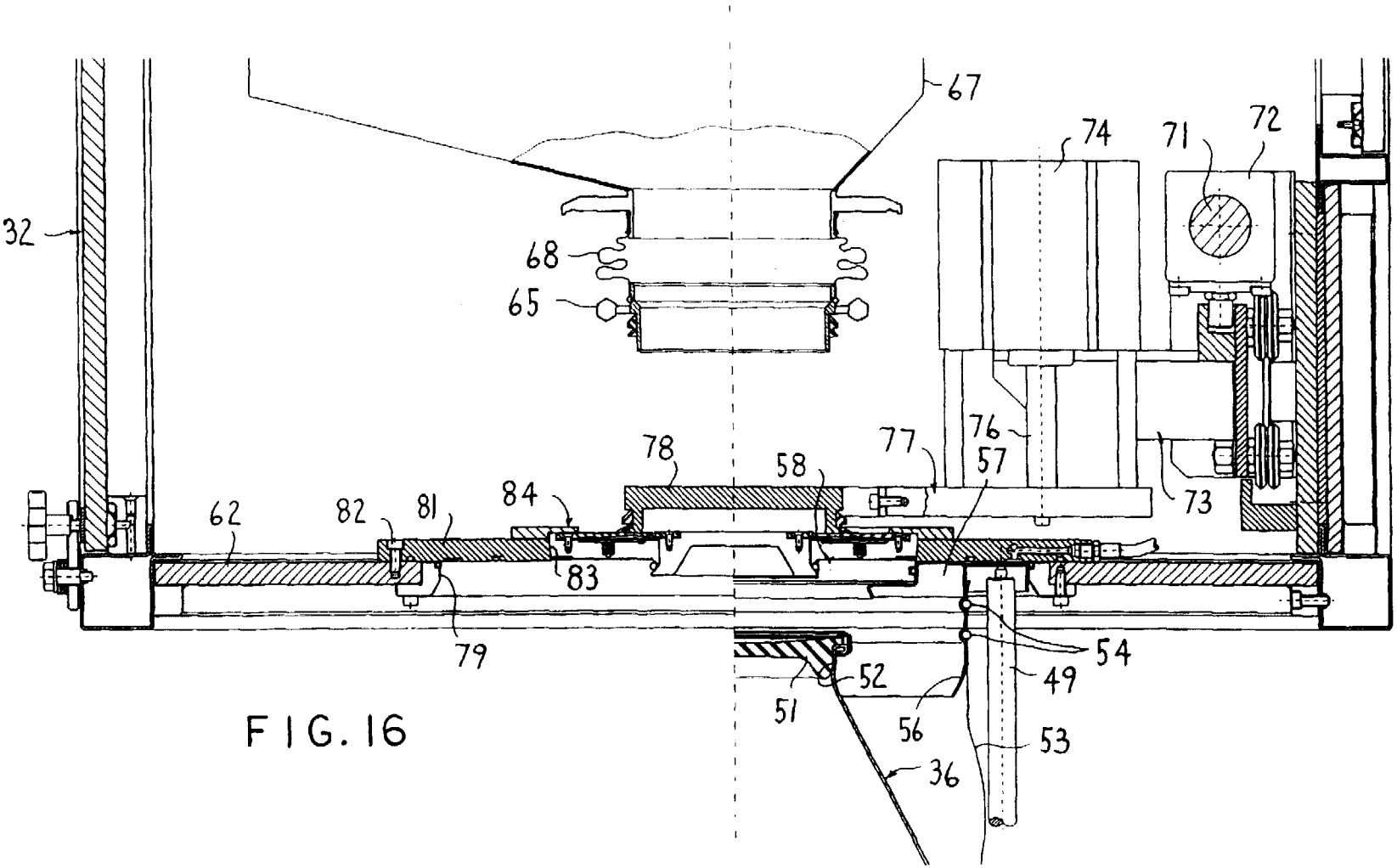
FIG. 16 is an enlarged sectional view illustrating the structure for effecting a removal and replacement of a binstopper and in a first position thereof.

The bottom wall 62 (FIG. 16) of the sealed chamber 32 includes a centrally disposed opening 79 oriented beneath the outlet of the sleeve 68. The opening 79 is covered or closed off by a plate 81 secured by a plurality of fasteners 82 to the bottom wall 62. The plate 81 has a centrally disposed opening 83 therein which is covered by a removable cover 84. As a result, and prior to a removal of the cover 84, the interior of the sealed chamber 32 remains sealed from the outside environment. The left half of FIG. 16 illustrates the arrangement prior to the placement of a bin 36 and its accompanying plate 57 onto the upper surface of the secondary platform 43. The right half of FIG. 16 illustrates the presence of the transportable bin 36 and its associated plate 57.

OPERATION

Although the operation of the apparatus embodying the invention has been indicated somewhat above, the operation will be described in detail hereinbelow to assure a more complete understanding of the invention.

As depicted in FIG. 3, reactants are introduced into the aseptic reactor 16 for the purpose of producing a pharmaceutical product. Thereafter, the pharmaceutical product is delivered through the outlet 17 into an inlet port 19 of the filter/dryer mechanism 18 for the purpose of recovering the pharmaceutical product. The pharmaceutical product is extracted from the filter/dryer 18 through an outlet port 21 and delivered through piping 24 to the inlet port 27 of the aseptic hammer mill 26 for the purpose of delumping the pharmaceutical product to produce a final powder product. Thereafter, the final powder product is delivered through an outlet port 28 into the storage hopper 29 and thence to the aseptic dosing device 31 for controlling an amount of final powder product to be dispensed into a transportable bin. A transportable bin 36 and its associated plate 57 supporting a sterile bag 53 are placed onto the upper surface of the secondary platform 43 so as to orient the open upper end 52 of the transportable bin 36 in axial alignment with the extendable sleeve 68 connected to the outlet from the aseptic dosing device 31. At this point in the operation, the system is in the configuration illustrated in FIG. 5 with the upper surface of the plate 57 being spaced from the lower surface of the plate 81.

Figure 6:
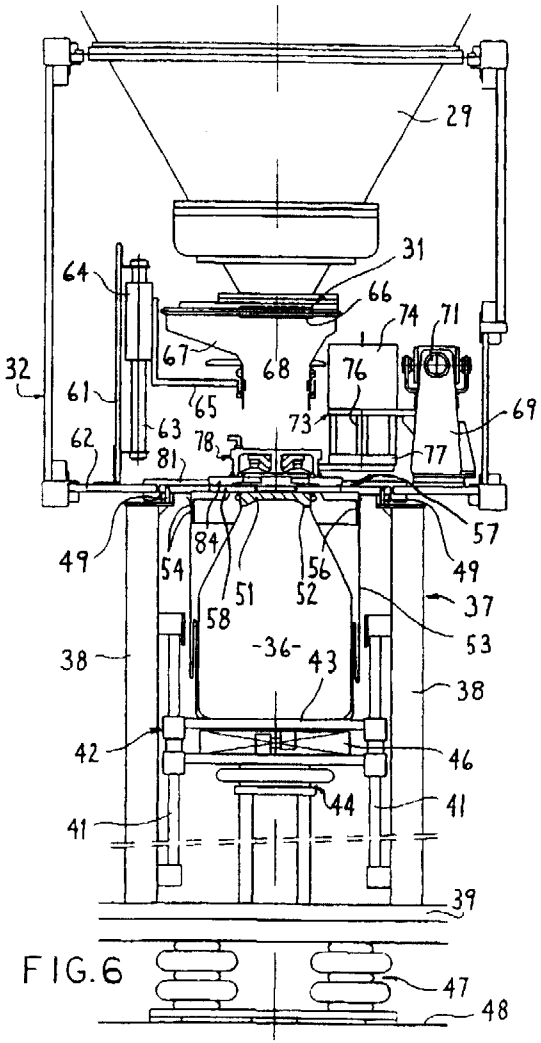
FIGS. 5–14 illustrate an apparatus for performing a sequence of method steps for effecting an aseptic dosing of pharmaceutical powdered product into a presterilized transportable bin and effecting an encasement and sealing of the transportable bin inside the sterile bag.
Figure 5:
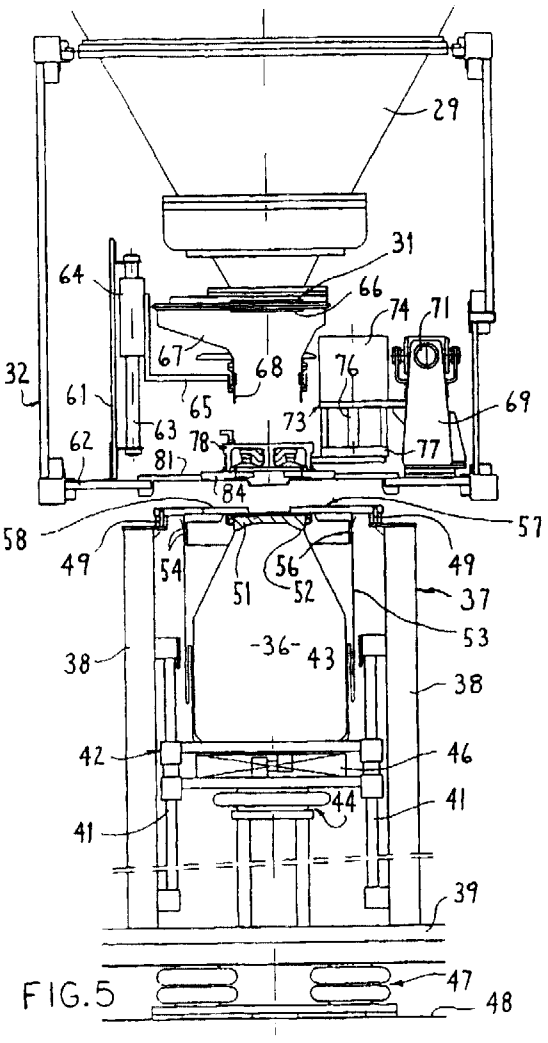
Figure 8:
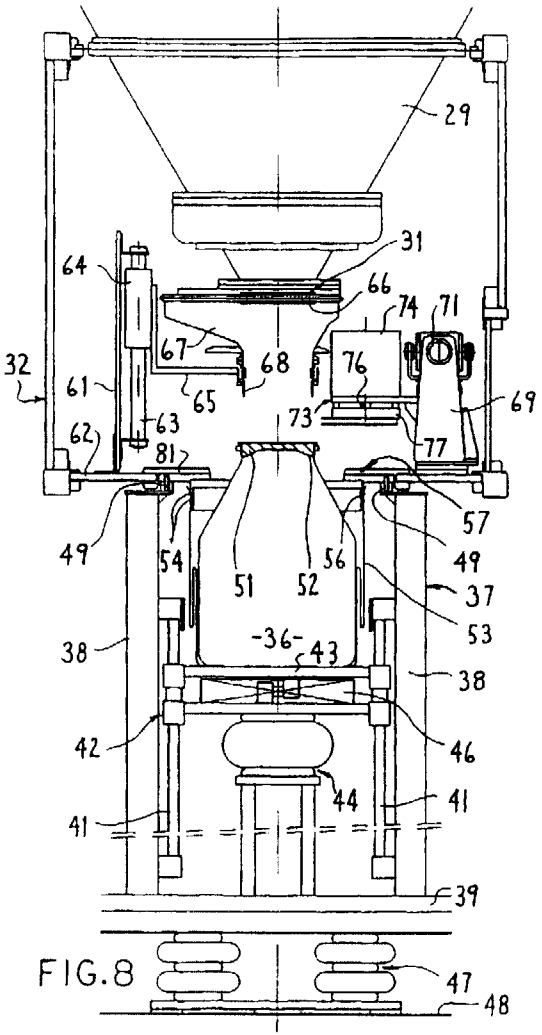
Figure 7:
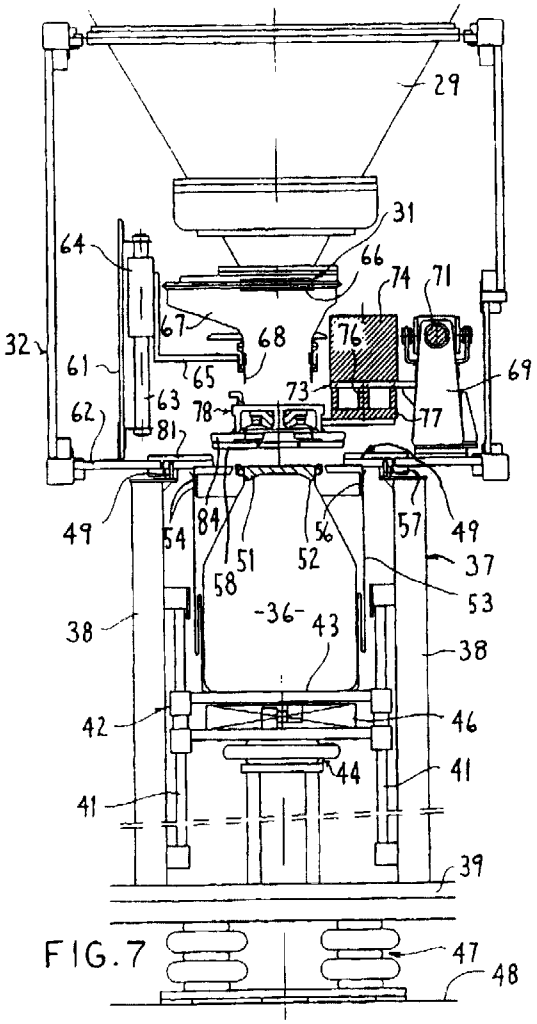
Figure 10:
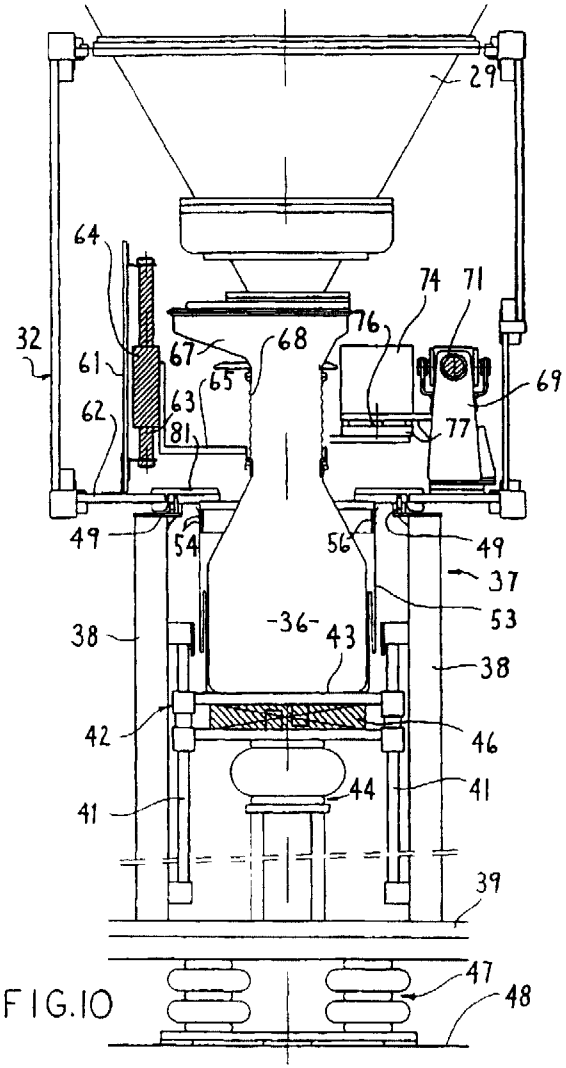
Figure 17A:
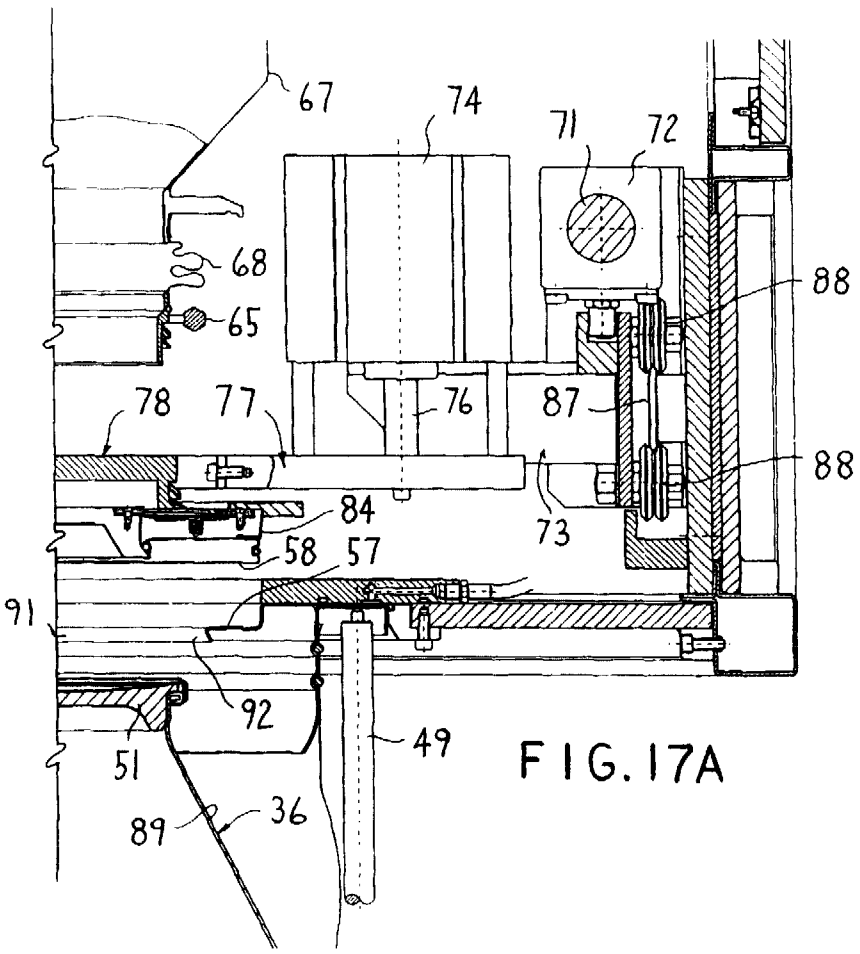
FIGS. 17A and 17B illustrate the structure of FIG. 16 in alternate positions.
Figure 17B:
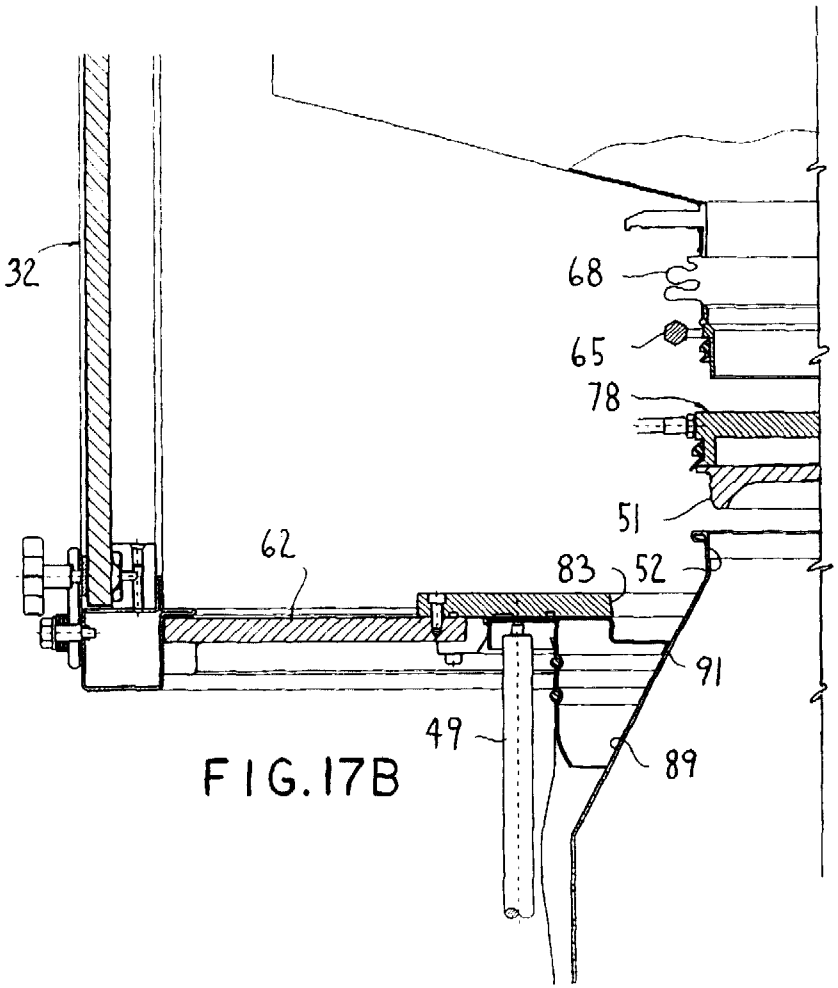
Figure 18:
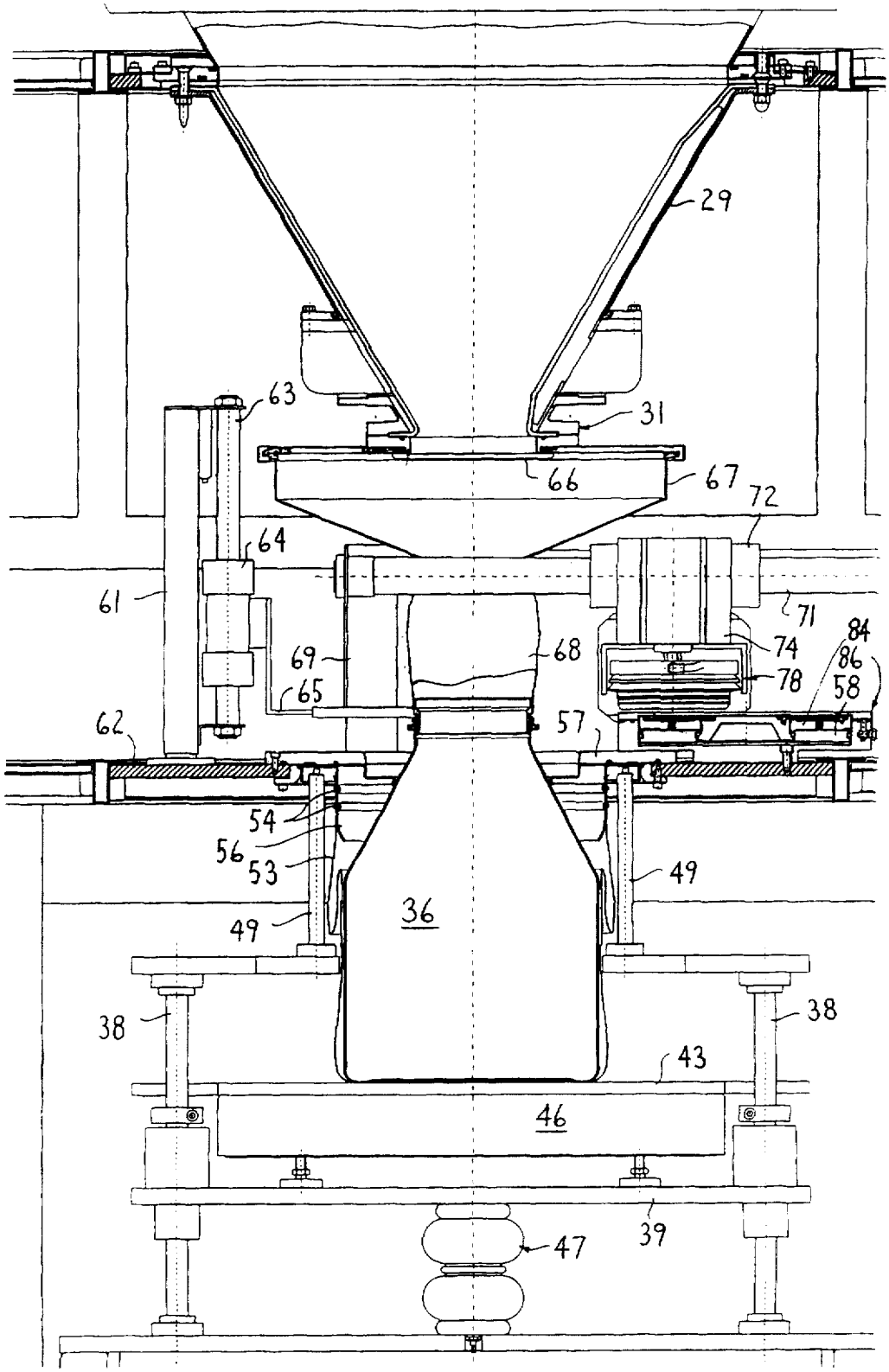
FIG. 18 is a sectional view of the dosing section of the apparatus and at an angle oriented at 90° to the illustrations of FIGS. 5–14.

The drive mechanism 47 is next activated to raise the platform 39 from the position illustrated in FIG. 5 to the position illustrated in FIG. 6. This causes the upper surface of the plate 57 to come into engagement with the lower surface of the plate 81 as illustrated in FIG. 6 and the right half of FIG. 16 and causes the cover 84 to become engaged with the cover 58. In this position, the suction activated gripper 78 is activated to simultaneously effect a gripping of the cover 58 on the plate 57 and a removal of the cover 84 from its engagement with the plate 81. Thereafter, the linear actuator 74 is activated to raise the cover 84 with the cover 58 being fastened thereto until the configuration illustrated in FIG. 7 is achieved. The linear actuator 74 has been cross hatched in FIG. 7 for the purpose of symbolizing its activation. Similarly, the linear actuator 72 is also activated to move the pair of covers 84 and 58 away from the plane of the drawing for FIG. 7, namely, to the right illustrated in FIG. 18. The pair of covers 84 and 58 are delivered to a holding apparatus 86 adapted to hold the pair of covers 84 and 58 in a parked condition out of the way. FIG. 17A also illustrates the simultaneous lifting of the pair of covers 84 and 58 by the suction activated gripper 78. FIG. 17A also illustrates a rail construction 87 extending parallel to the shaft 71 and a pair of vertically spaced wheels 88 riding on opposite upper and lower edges of the rail 87 for facilitating a movement of the bracket assembly 73 in a precisely controlled manner parallel to the longitudinal axis of the shaft 71 so as to bring the pair of covers 84 and 58 to the holding apparatus 86 illustrated in FIG. 18. FIG. 8 purposefully deletes the illustration of the suction activated gripper 78 to symbolize that it is out of the plane of FIG. 8.

Next, the drive mechanism 44 is activated as shown in FIG. 8 to lift the transportable bin 36 relative to the plate 57. The outer tapered surface 89 of the transportable bin 36 is brought into engagement with a tapered surface 91 encircling the opening 92 through the plate 57 as illustrated in FIG. 17A. The engagement between the exterior tapered surface 89 on the bin 36 and the tapered surface 91 of the opening 92 effects a sealed connection therebetween.

Figure 9:
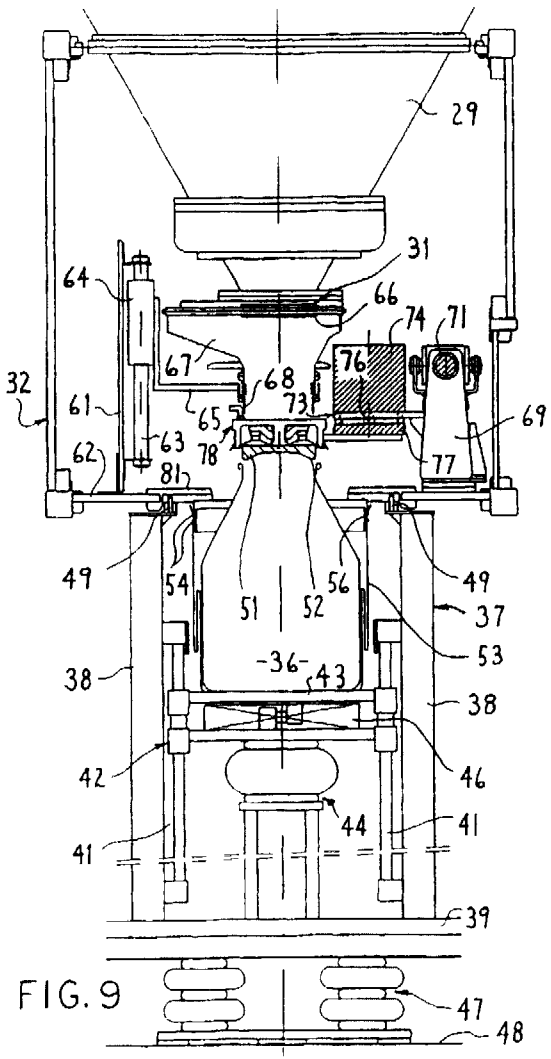
Figure 12:
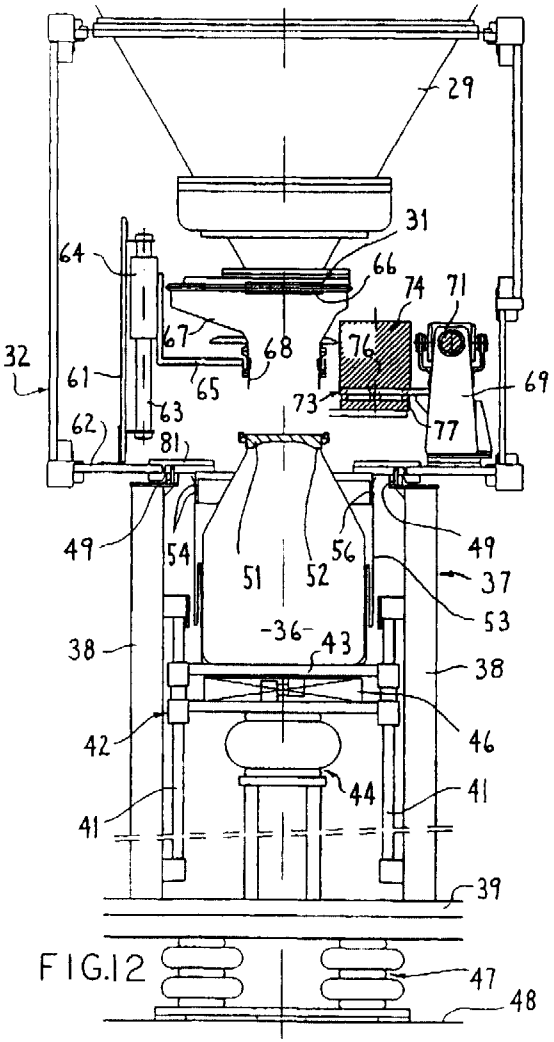

Thereafter, the linear actuator 72 is again activated to bring the suction activated gripper 78 back into the plane of the drawing and particularly the configuration illustrated in FIG. 9. The linear actuator 74 is again activated to lower the suction activated gripper 78 into engagement of the upper surface of the binstopper 51 and through a manipulation of the suction activation mechanism, grip the binstopper 51. Upon a reversal of the linear actuator 74, the suction activated gripper 78 is lifted carrying therewith the binstopper 51 from the now open upper end 52 of the transportable bin 36. The linear actuator 72 is activated to take the suction activated gripper 78 and binstopper 51 to a location out of the plane illustrated in FIG. 9 and to the configuration generally depicted in FIG. 10. Thereafter, the linear actuator 64 is activated to lower the bracket 65 carrying therewith the extendable sleeve 68 downwardly and projecting it into the open upper end 52 of the transportable bin 36. Thereafter, the slide gate mechanism 66 on the dosing device 31 can be activated to the open position to allow aseptic pharmaceutical product to leave the storage hopper 29 and enter the transportable bin 36. The scale 46 is activated during this time period to weight the contents as they enter the transportable bin. The tare weight is defined before the transportable bin 36 is moved into its centering position. Following the placement of a designated amount of pharmaceutical product into the transportable bin 36, the slide gate mechanism 66 is moved to the closed position to stop the further flow of pharmaceutical product out of the storage hopper 29 and into the transportable bin 36.

Figure 11:
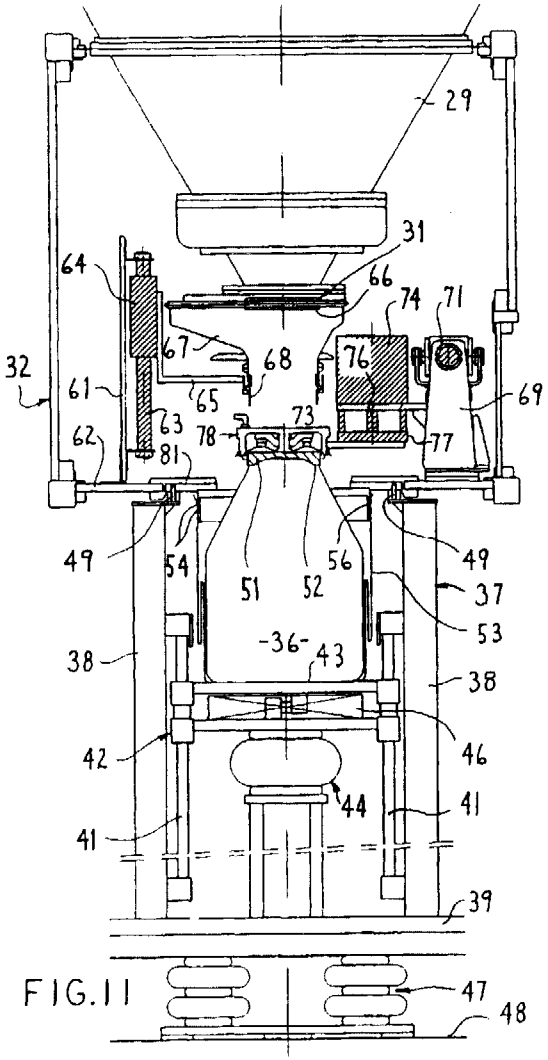
Figure 14:
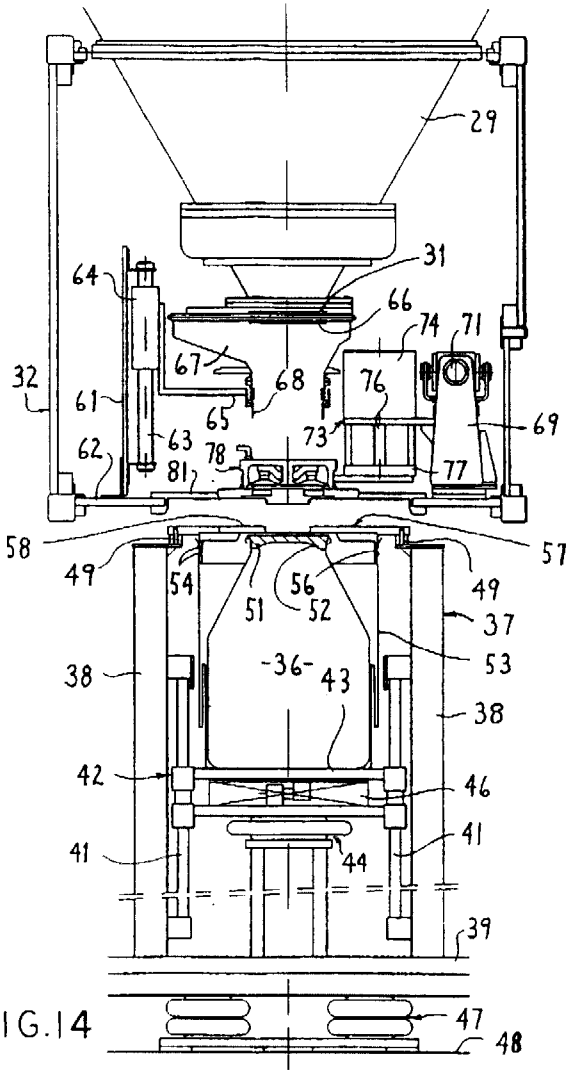

Next, the linear actuator 64 is activated to retract the sleeve 68 to the FIG. 11 configuration. Similarly, the linear actuator 72 is activated to bring the linear actuator 74 and suction activated gripper 78 carrying the binstopper 51 into the plane of the drawing as depicted in FIG. 11 so as to orient the suction activated gripper 78 and binstopper 51 over the open upper end 52 of the transportable bin 36. The linear actuator 74 then effects a movement of the binstopper 51 downwardly and into the open upper end 52 of the transportable bin 36 and thereafter raises the gripper 78, following a release of the binstopper 51, and moves the gripper 78 to a position out of the plane of the drawing as symbolized by the configuration in FIG. 12.

Figure 13:
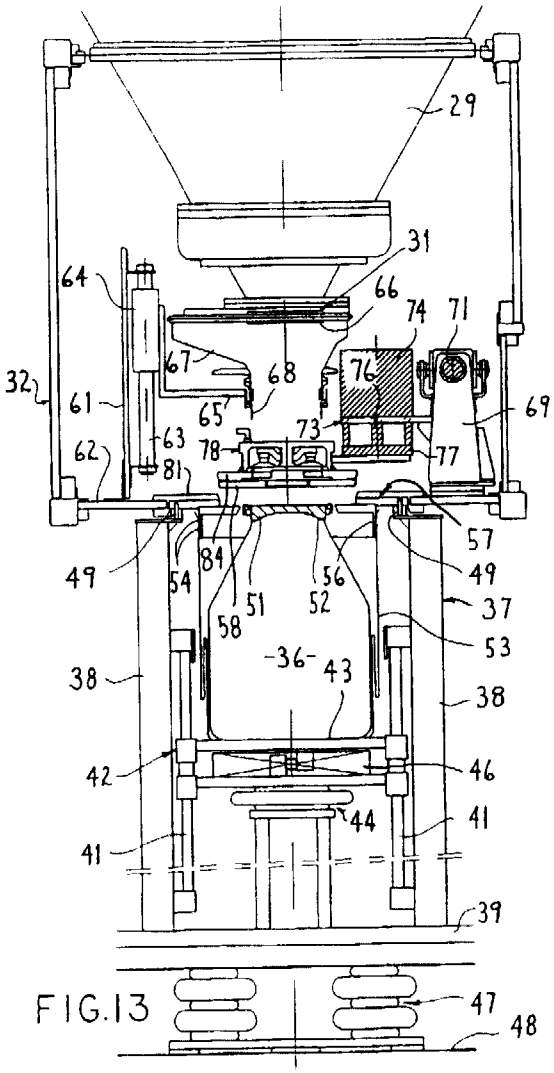

Thereafter, and as shown in FIG. 13, the drive mechanism 44 is operated to lower the transportable bin 36. At the same time, the linear actuator 74 and gripper 78 fastened thereto has reacquired the pair of coupled together covers 84 and 58 from the holding apparatus 86. The linear actuator 72 will, upon an appropriate activation thereof, bring the pair of covers 84 and 58 secured to the suction activated gripper 78 into the configuration illustrated in FIG. 13. Appropriate operation of the linear actuator 74 will cause a placement of the pair of covers 84 and 58 back into their original position closing off the respective openings 83 and 92. Thereafter, the drive mechanism 47 is activated to lower the secondary platform 43 to separate the upper surface of the plate 57 from its engagement with the lower surface of the plate 81. The covers 84 and 58 also become uncoupled during a deactivation of the gripper 78. The sealed chamber 32 remains now closed off from the outside.

Prior to an operation of the drive mechanism 47, and if desired, an operator can access the sealed chamber 32 through a gloved wall (not illustrated) for the purpose of fastening a clip C (FIG. 15) onto the binstopper 51 so as to lockingly secure the binstopper 51 to the transportable bin 36. Thereafter, the pair of covers 84 and 58 can be placed into their closed position with respect to the respective openings 83 and 92 as aforesaid.

Figure 15:
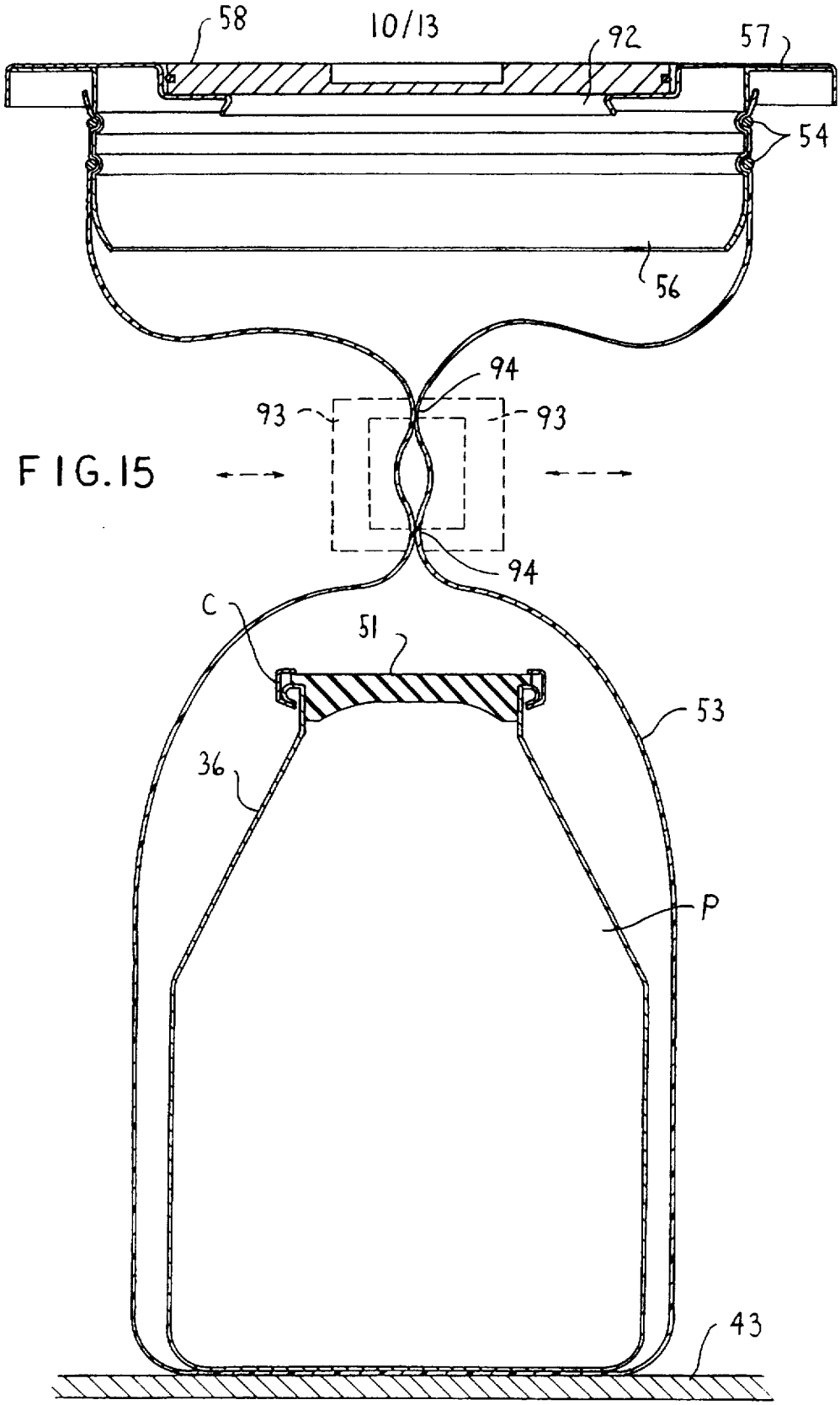
FIG. 15 is an enlarged cross section of a transportable bin sealed inside a sealed and sterile bag.

Next, the transportable bin 36 can be removed from the filling station 37 along with the associated plate 57 and the cylindrical shell 56 to which the upper end of the sterile bag 53 is secured by the pair of O-rings 54. The assembly consisting of the transportable bin 36 inside of the sterile bag 53 can be taken to a bag sealing station whereat a pair of bag sealing anvils 93 can be employed to effect a sealed closing of the bag adjacent the rim region thereof oriented intermediate the upper end of the transportable bin 36 and the lower edge of the cylindrical shell 56 as schematically depicted in FIG. 15. Now the powder product P inside the transportable bin 36, which bin is in turn inside of the sterile bag 53 sealingly closed as at 94, is now ready for transport.

The aforesaid methodology, depicted in FIG. 1, and apparatus have accomplished the filling of a transportable bin with no ability for the powdered product to escape into the local environment. Further, the aseptic condition of the equipment prior to and during the filling operation preserves the integrity of the powdered product inside of the transportable bin 36.

ALTERNATE CONSTRUCTION (FIG. 4)

Figure 4:
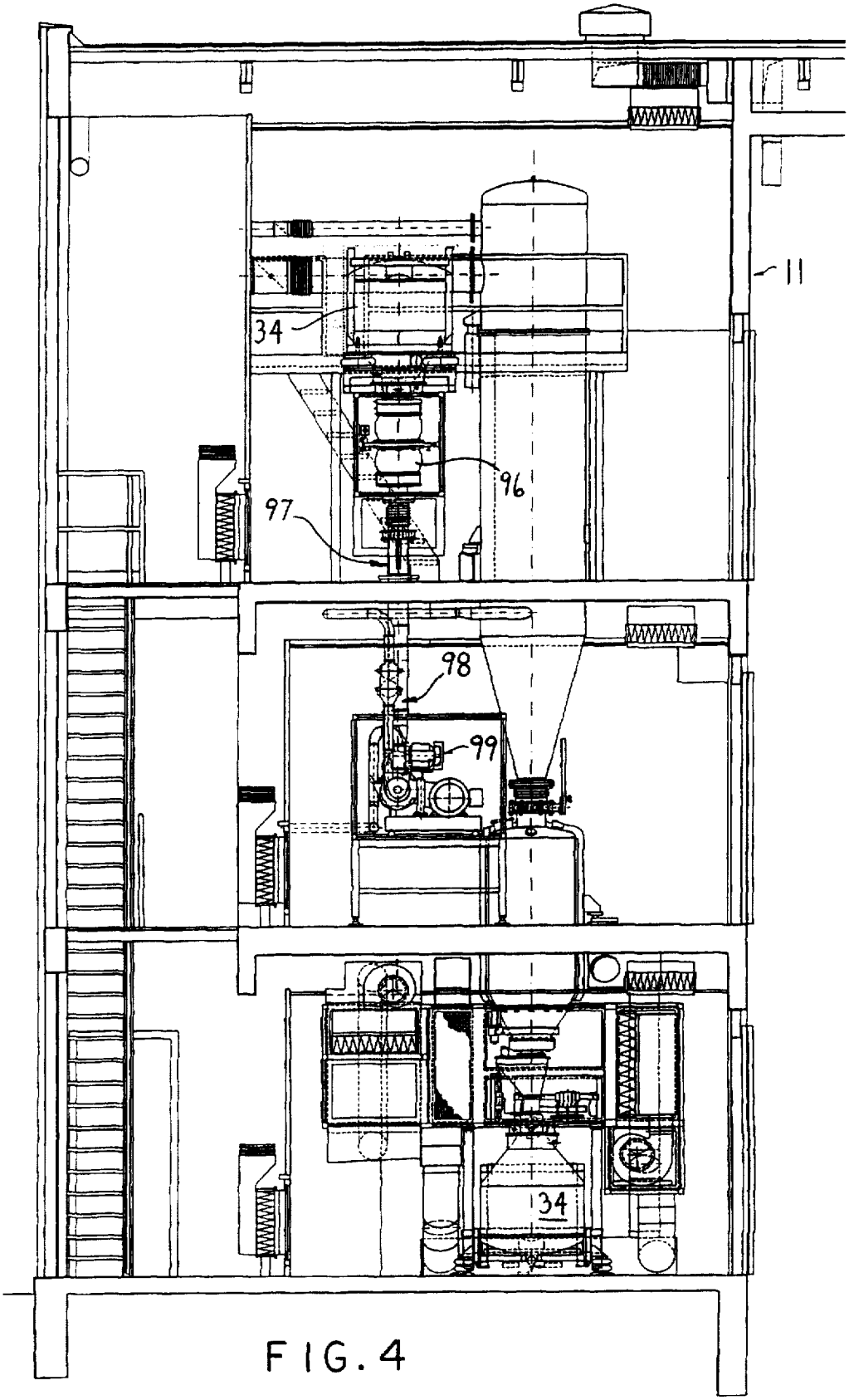
FIG. 4 is a side elevational view of an apparatus for aseptically repackaging a pharmaceutical product.

In some instances, other processes than delumping e.g. micronization are in need to meet final product requirements. In this instance, the set up will be as in FIG. 3. A 600 liter bin 34 equipped with the same cover 58 and matching cap plate 57 design will be presterilized inside before filling. After aseptic harvesting, using the same method as described before, the bin 34 will be transported to the workcenter designed as shown in FIG. 4.

Figure 2:
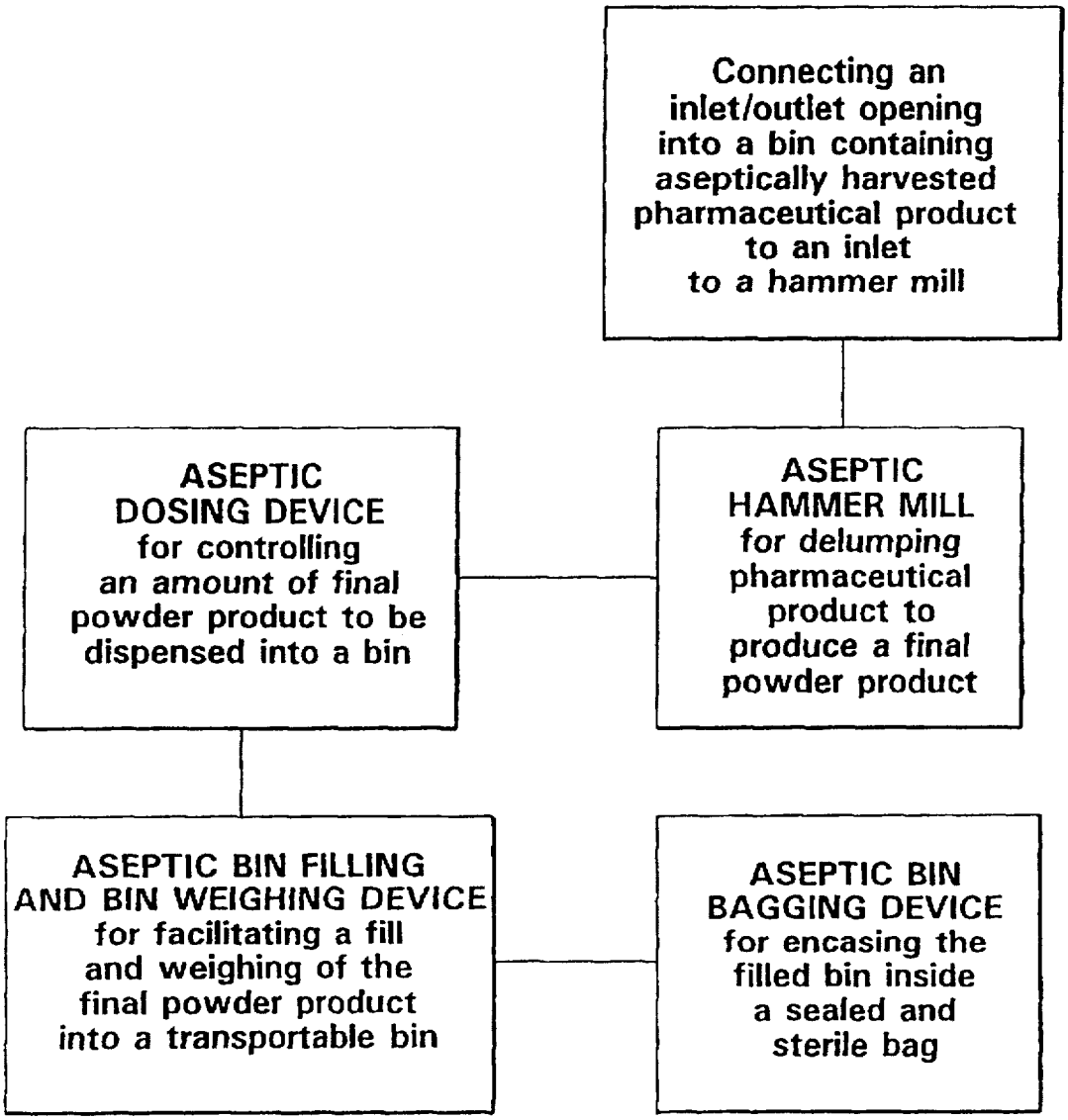
FIG. 2 is a schematic block diagram of a method for repackaging an aseptically produced pharmaceutical product.

The bin 34 containing the aseptically harvested product, will be lifted inverted and installed on the docking system 96. The same cover 58 lifting system is used to allow the feeding of the product through the piping to the micronizing mill. Further operations take place as described before, for filling into the transportable 16 liter bin enclosed in a sterile bag or into a 600 liter presterilized bin for further aseptic bulk handling. As a result, the process depicted in FIG. 2 has been performed.

Although particular preferred embodiments of the invention have been disclosed in detail for illustrative purposes, it will be recognized that variations or modifications of the disclosed apparatuses, including the rearrangement of parts, lie within the scope of the present invention.

The embodiments of the invention in which an exclusive property or privilege is claimed are defined as follows:

1. A method of aseptically producing, harvesting and packaging a pharmaceutical product, comprising the steps of:

introducing a reactant into an aseptic reactor;

conducting a reaction to produce pharmaceutical product;

introducing the produced pharmaceutical product into a filter/dryer for recovering the pharmaceutical product;

aseptically delivering the recovered pharmaceutical product to a hammer mill for delumping or a micronizing mill to size the recovered pharmaceutical product to produce a final powder product;

aseptically introducing the final powder product into a dosing device;

enveloping a transportable bin with a removable binstopper inside an open top bag and sealingly engaging a rim region of the open top of the bag to a plate having an opening therethrough closable by a removable bagstopper;

placing the subassembly consisting of the bag, transport bin, binstopper, plate and bagstopper beneath the dosing device; and aseptically filling the final powder product into the transportable bin.

2. The method according to claim 1, wherein said step of aseptically introducing the final powder product into a dosing device includes the step of weighing the dosage and the transportable bin as the dosage is filled into the transportable bin.

3. The method according to claim 1, wherein prior to said placing step, a sterilizing of the interior and exterior of the subassembly consisting of a bag, transport bin, binstopper, plate and the bagstopper occurs.

4. The method according to claim 3, wherein said step of aseptically filling the final powder product into the transportable bin includes the step of aseptically sealingly closing a now sterile bag with the transportable bin oriented therein.

5. The method according to claim 4, wherein the sealingly closing of the sterile bag is accomplished by welding the material of the bag walls together adjacent the rim region.

6. The method according to claim 4, wherein said placing step further includes a removal of the bagstopper so as to provide access to the binstopper, removing the binstopper so as to provide access to the interior of the transportable bin, and aseptically connecting the dosing device to the interior of the transportable bin.

7. A method of repackaging an aseptically produced pharmaceutical product, comprising the steps of:

connecting an opening into a pharmaceutical product containing bin to an inlet to a hammer or micronizing mill;

aseptically unloading the bin into the hammer mill for delumping or micronizing mill for sizing the pharmaceutical product to produce a final powder product;

aseptically introducing the final powder product into a dosing device;

enveloping a transportable bin with a removable binstopper inside an open top bag and sealingly engaging a rim region of the open top of the bag to a plate having an opening therethrough closable by a removable bagstopper;

placing the subassembly consisting of the bag, transport bin, binstopper, plate and bagstopper beneath the dosing device; and aseptically filling the final powder product into the transportable bin.

8. The method according to claim 7, wherein said step of introducing the final powder product into a dosing device includes the step of weighing the dosage and the transportable bin as the dosage is filled into the transportable bin.

9. The method according to claim 7, wherein prior to said placing step, a sterilizing of the interior and exterior of the subassembly consisting of a bag, transport bin, binstopper, plate and the bagstopper occurs.

10. The method according to claim 9, wherein said step of aseptically filling the final powder product into the transportable bin includes the step of aseptically sealingly closing a now sterile bag with the transportable bin oriented therein.

11. The method according to claim 10, wherein the sealingly closing of the sterile bag is accomplished by welding the material of the bag walls together adjacent the rim region.

12. The method according to claim 10, wherein said placing step further includes a removal of the bagstopper so as to provide access to the binstopper, removing the binstopper so as to provide access to the interior of the transportable bin, and aseptically connecting the dosing device to the interior of the transportable bin.

* * * * *